US010168042B1

(12) United States Patent
Hjaltason

(10) Patent No.: US 10,168,042 B1
(45) Date of Patent: Jan. 1, 2019

(54) SYSTEM AND METHOD FOR ILLUMINATING DECORATIVE AND GRAPHIC ELEMENTS ON A CONTAINER

(71) Applicant: Thor Daniel Hjaltason, Mesquite, TX (US)

(72) Inventor: Thor Daniel Hjaltason, Mesquite, TX (US)

( * ) Notice: Subject to any disclaimer, the term of this patent is extended or adjusted under 35 U.S.C. 154(b) by 159 days.

(21) Appl. No.: 15/098,773

(22) Filed: Apr. 14, 2016

Related U.S. Application Data

(60) Provisional application No. 62/262,199, filed on Dec. 2, 2015.

(51) Int. Cl.

| | |
|---|---|
| ***F21V 33/00*** | (2006.01) |
| ***F21V 21/096*** | (2006.01) |
| ***F21L 4/02*** | (2006.01) |
| ***F21V 3/04*** | (2018.01) |
| ***A45C 13/00*** | (2006.01) |
| ***A45C 13/10*** | (2006.01) |
| *F21Y 101/02* | (2006.01) |

(52) U.S. Cl.
CPC ..... *F21V 33/0004* (2013.01); *A45C 13/005* (2013.01); *A45C 13/1069* (2013.01); *F21L 4/02* (2013.01); *F21V 3/049* (2013.01); *F21V 21/096* (2013.01); *F21Y 2101/02* (2013.01)

(58) Field of Classification Search
CPC ..... A45C 13/005; F21V 33/0004
USPC ..... 362/156
See application file for complete search history.

(56) References Cited

U.S. PATENT DOCUMENTS

| | | | | |
|---|---|---|---|---|
| 4,926,296 A * | 5/1990 | Blume | ..... | A45C 15/06 206/457 |
| 6,059,423 A * | 5/2000 | Knopick | ..... | A45C 15/06 362/109 |
| 2005/0047120 A1* | 3/2005 | Sargent | ..... | A45C 15/06 362/156 |

* cited by examiner

*Primary Examiner* — Robert J May
(74) *Attorney, Agent, or Firm* — Eldredge Law Firm, LLC; Richard Eldredge; Beth Felix

(57) ABSTRACT

A combination bag and lighting system. The bag includes a bottom surface; two opposing sides; a back side; and a front side. A visual element is secured to the front side and is illuminated with a light source of the lighting system carried within an inner area of the bag.

18 Claims, 18 Drawing Sheets

SYSTEM AND METHOD FOR ILLUMINATING DECORATIVE AND GRAPHIC ELEMENTS ON A CONTAINER

BACKGROUND

1. Field of the Invention

The present invention relates generally to illuminated articles, and more specifically to a container with illuminated decorative or graphic elements.

2. Description of Related Art

Bags for carrying objects are well known in the art. For example, FIG. 1 is an oblique view of a conventional bag 101 having a body 103 with integral sides 105, 107, 109, and 111. The body forms a cavity 113 and a front surface 115 and back surface 107 that can be utilized to display an indicia such as a logo, image, trademark or decor.

Accordingly, although effective in carrying items within cavity 113, the bag 101 has limited marketing means. In addition, it should be understood that bag 101 is not generally intended for marketing and/or display means. Accordingly, the bag sides are not typically composed of materials to enable light to pass therethrough for an aesthetically pleasing appearance. Accordingly the said bag 101 is typically folded and stored away until used Although great strides have been made in the area of containers for carrying objects, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
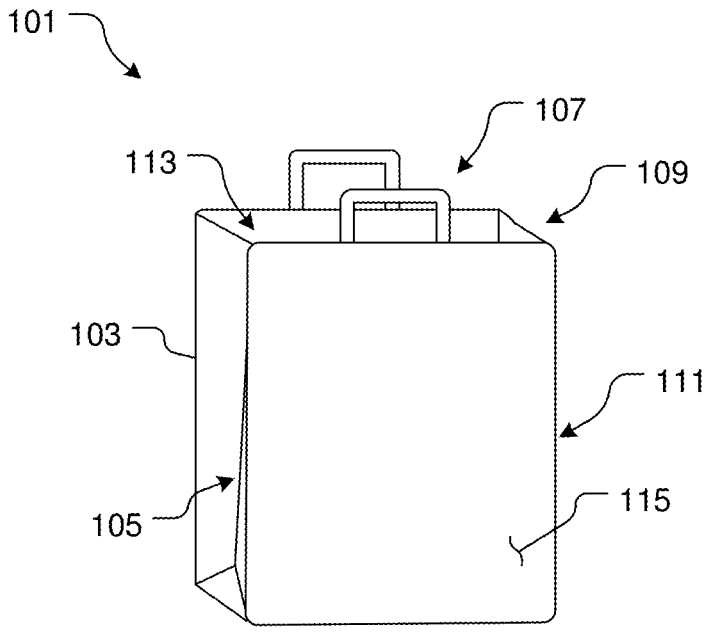
FIG. 1 (Prior Art)
FIG. 1 is an oblique view of a conventional bag.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
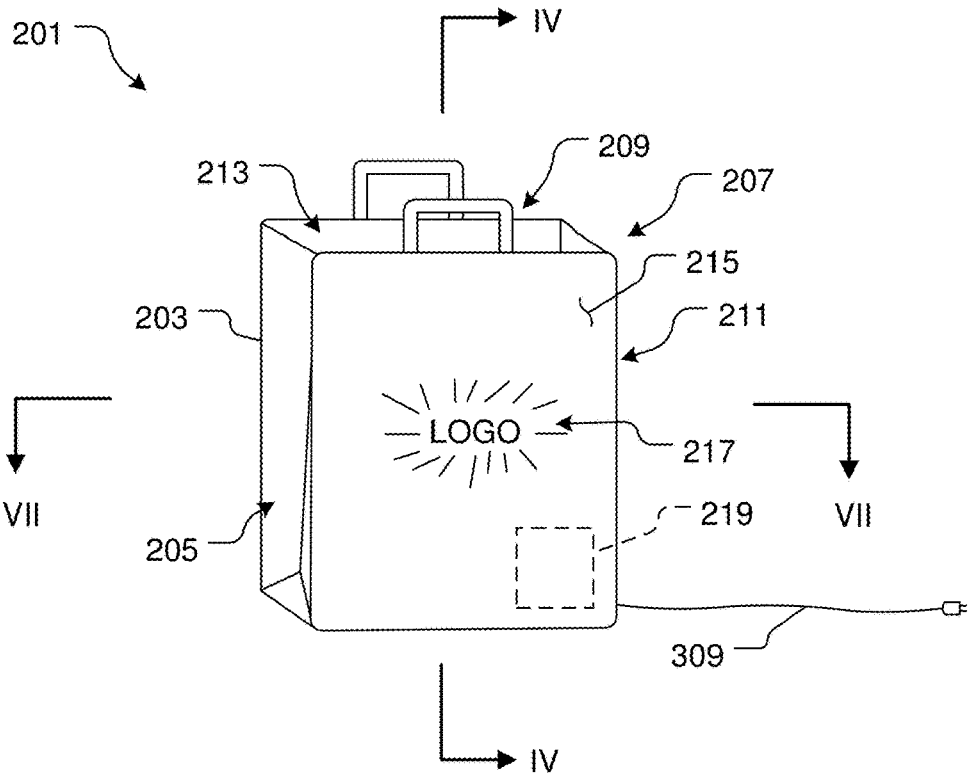
FIG. 2 is an oblique view of a bag with lighting system in accordance with a preferred embodiment of the present application.

Referring now to the drawings wherein like reference characters identify corresponding or similar elements throughout the several views, FIG. 2 is an oblique view of a bag 201 with a light system 219 for illuminating an illuminated decorative or graphic element 217 in accordance with a preferred embodiment of the present application.

In the exemplary embodiment, the light system 219 is operably associated with a handbag 201 for display and/or carrying items therein. It will be appreciated that the features of the light system 219 discussed herein could be utilized with various types of container, for example, box 1001 and/or other containers having different shapes and sizes.

Bag 201 includes a body 203 with sides 205, 207 integral with a back side 209 and a front side 211. The body 203 forms a cavity 213 for carrying items and/or to carry the light system 219 therein. The front side 211 has a front surface 215 configured to have an illuminated decorative or graphic element 217 thereon. In the exemplary embodiment, the element 217 is a logo; however, it will be appreciated that other types of indicia could be used.

One of the points of novelty believed characteristic of the present application is the use of lighting system 219 to illuminate element 217 and/or the surrounding surfaces therearound. The lighting system 219 could also be utilized to illuminate the sides 205, 207, 209, 211 too. It is believed that illuminating the element 217 and/or the sides of the bag provides significant marketing appearance. Accordingly, the lighting system and associated bag is an improvement over existing conventional bags devoid of a lighting system.

Figure 3:
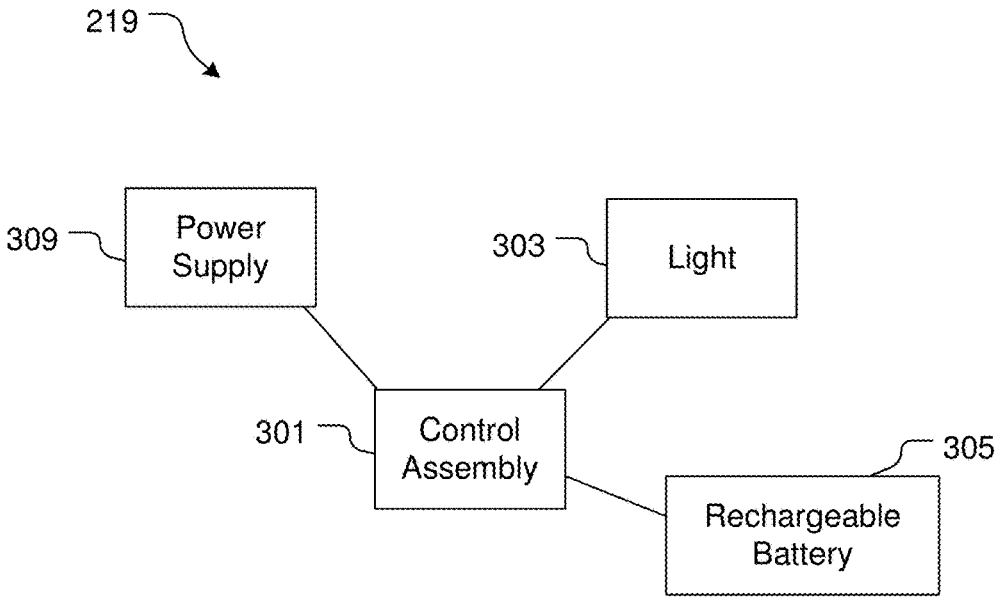
FIG. 3 is a simplified schematic of the lighting system of FIG. 2.

As shown in FIG. 3, a simplified schematic of the light system 219 is shown. In the contemplated embodiment, the light system 219 includes a Light source/rechargeable battery unit/power supply/programmed controller 301 conductively coupled to a light source 303, a rechargeable battery 305, and a power supply 309.

In one embodiment, the power supply 309 includes a cord configured to conductively couple the system 219 to a wall outlet (not shown). However, it is also contemplated having a battery supply 901 configured to provide electrical energy to the system 219 in an alternative embodiment.

Figure 4:
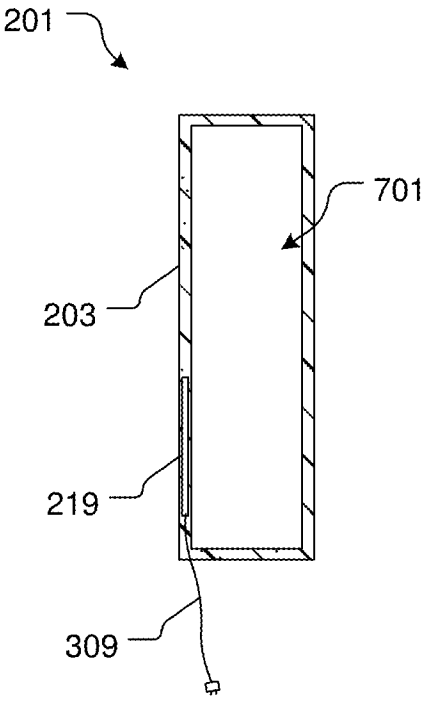
FIGS. 4-6 are top cross-sectional views of the bag with lighting system of FIG. 2 taken at VII-VII.
Figure 5:
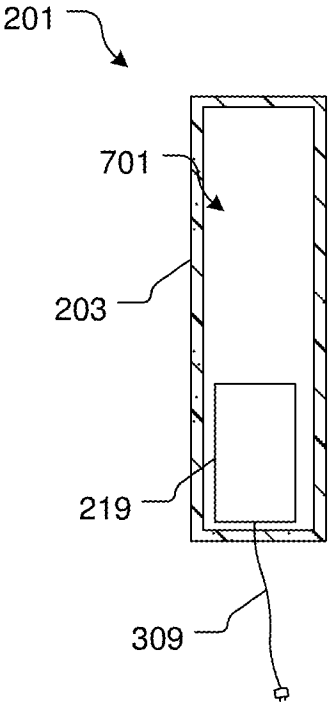
Figure 6:
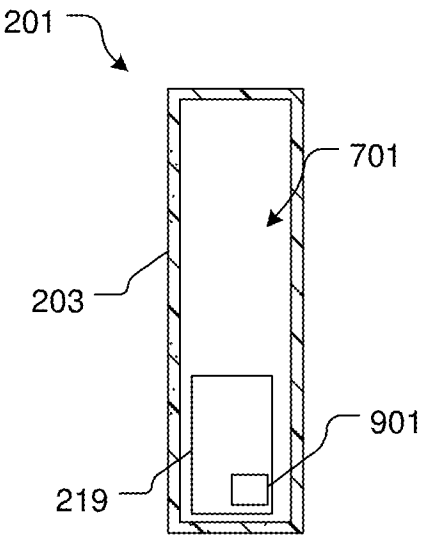
Figure 8:
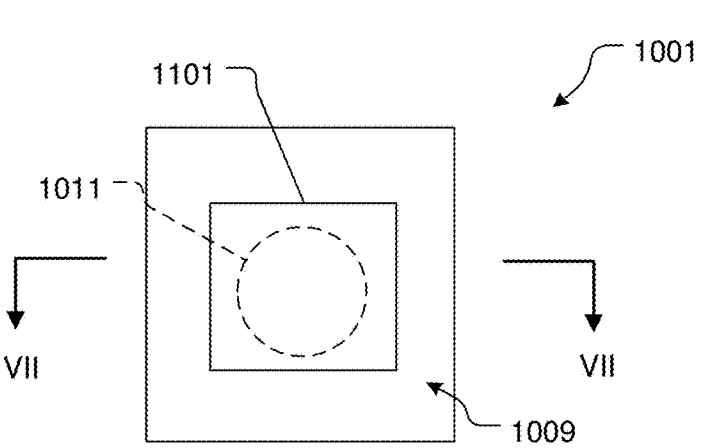
FIG. 8 is a top view of the box of FIG. 7 with a logo.
Figure 7:
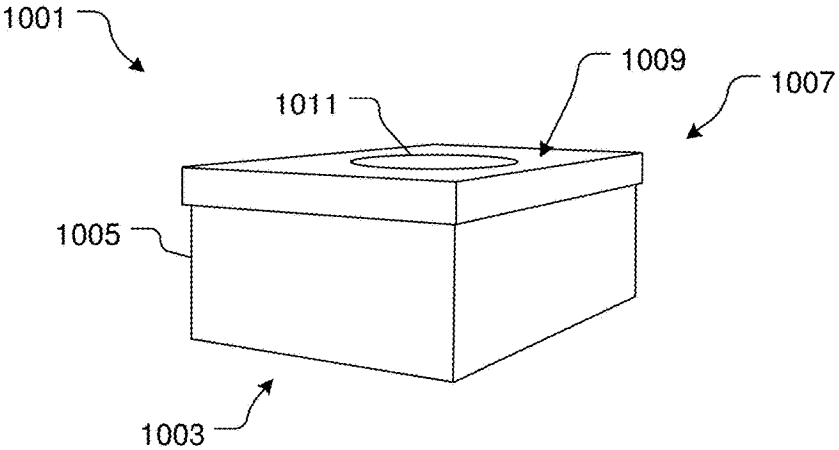
FIG. 7 is an oblique view of a box with lighting system in accordance with an alternative embodiment of the present application.
Figure 9:
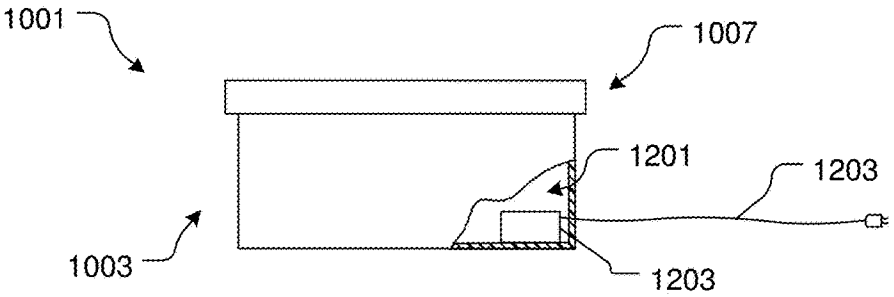
FIG. 9 is a side view of the box of FIG. 7.

In FIGS. 4-6 a top cross-sectional view of the bag 201 is shown. It will be appreciated that system 219 could be positioned on a bottom surface 701 or completely disposed within one of the sides of the body 203, as depicted in FIG. 4.

Referring now to FIGS. 7-10, various views of a box 1001 with light system 1201 are shown in accordance with an alternative embodiment of the present application. It will be appreciated that box 1001 includes one or more of the features discussed above with respect to bag 201 and vice-versa.

Box 1001 includes a body 1005 forming a cavity 1201 with a light system 1203 disposed therein. The box 1001 includes a container section 1003 and a lid 1007 configured to engage with the sides of body 1005. The lid 1007 includes a top surface 1009 with element 1101 thereon and an opening 1011 extending therethrough.

Figure 10:
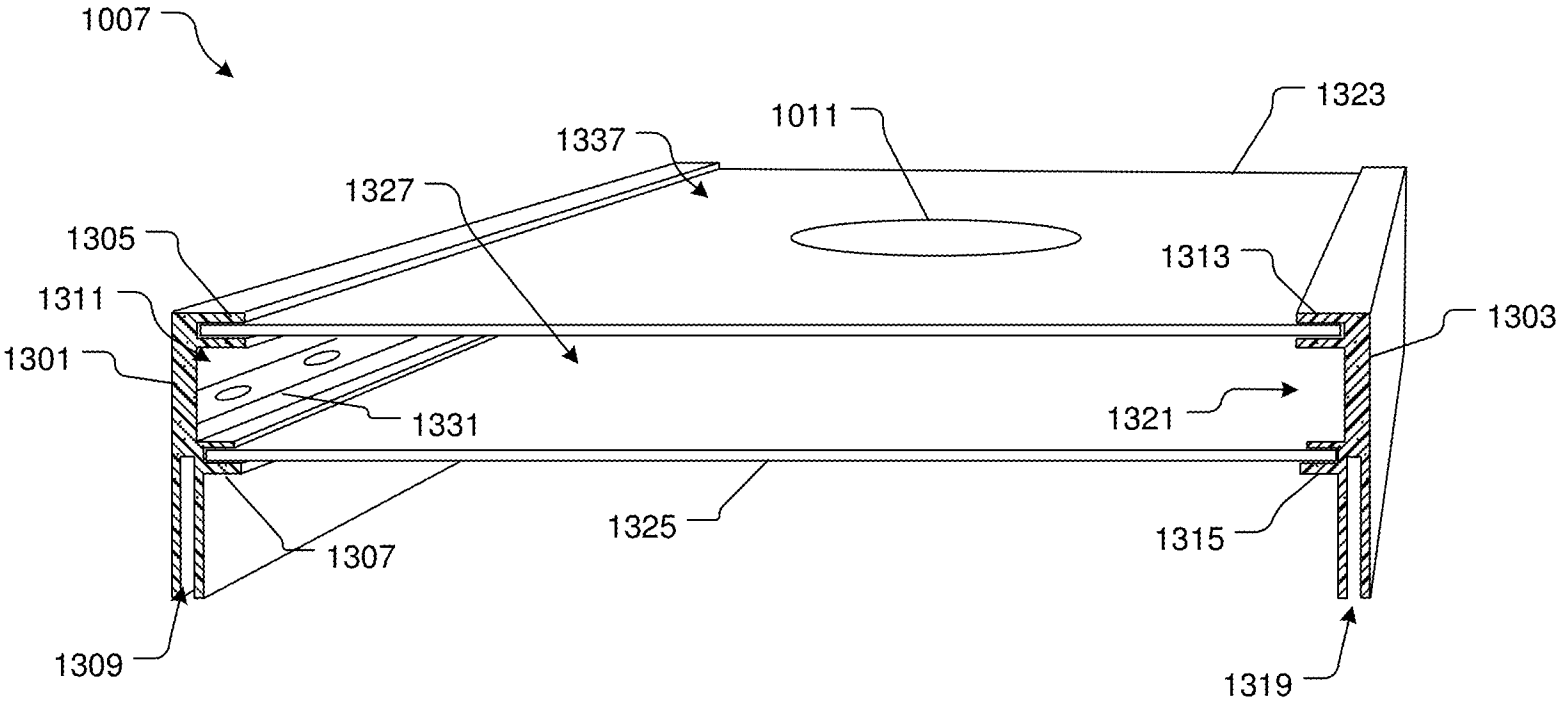
FIG. 10 is an oblique view of a lid of the box with lighting system of FIG. 7.

In FIG. 10, an oblique cross-sectional view of the lid 1007 is shown. In one contemplated embodiment, the lid 1007 includes two sides 1301, 1303 configured to engage with the body 1005 of box 1001. First side 1301 includes two ledges 1305, 1307 that form slots for respective top lid 1323 and bottom lid 1325 to slidingly engage therewith. Disposed between ledges 1305, 1307 is a side wall 1311 configured to engage with light source 1331. Accordingly, during use the light source 1331 illuminates the area 1327 disposed between lids 1323, 1325 and travels through one or more openings 1011 associated with the element 1101. It will be appreciated that the positioning of the opening along with the element could be substantially similar in form and function to the above described bag 201 with light system.

The side 1301 forms a channel 1309 which could be utilized to engage with the sides of the container 1003. Likewise, side 1303 includes a channel 1319, two ledges 1313, 1315, and a side 1321 substantially similar in form and function to side 1311.

In one contemplated embodiment, the light system could be positioned within the area 1327. Accordingly, the exemplary embodiment would allow the user to remove the light system upon removal of the lid. In another embodiment, the light system could be disposed within the walls of the container. In yet another embodiment, the lids 1323, 1325 could be composed of a transparent material that allows the light to travel therethrough.

Referring now to FIGS. 11-15 in the drawings, various side cross-sectional views of a bag 1401 are shown in accordance with an alternative embodiment of the present application. It will be appreciated that bag 1401 is similar in form and function to the bags discussed above and incorporates one or more of the features discussed herein.

Figure 11:
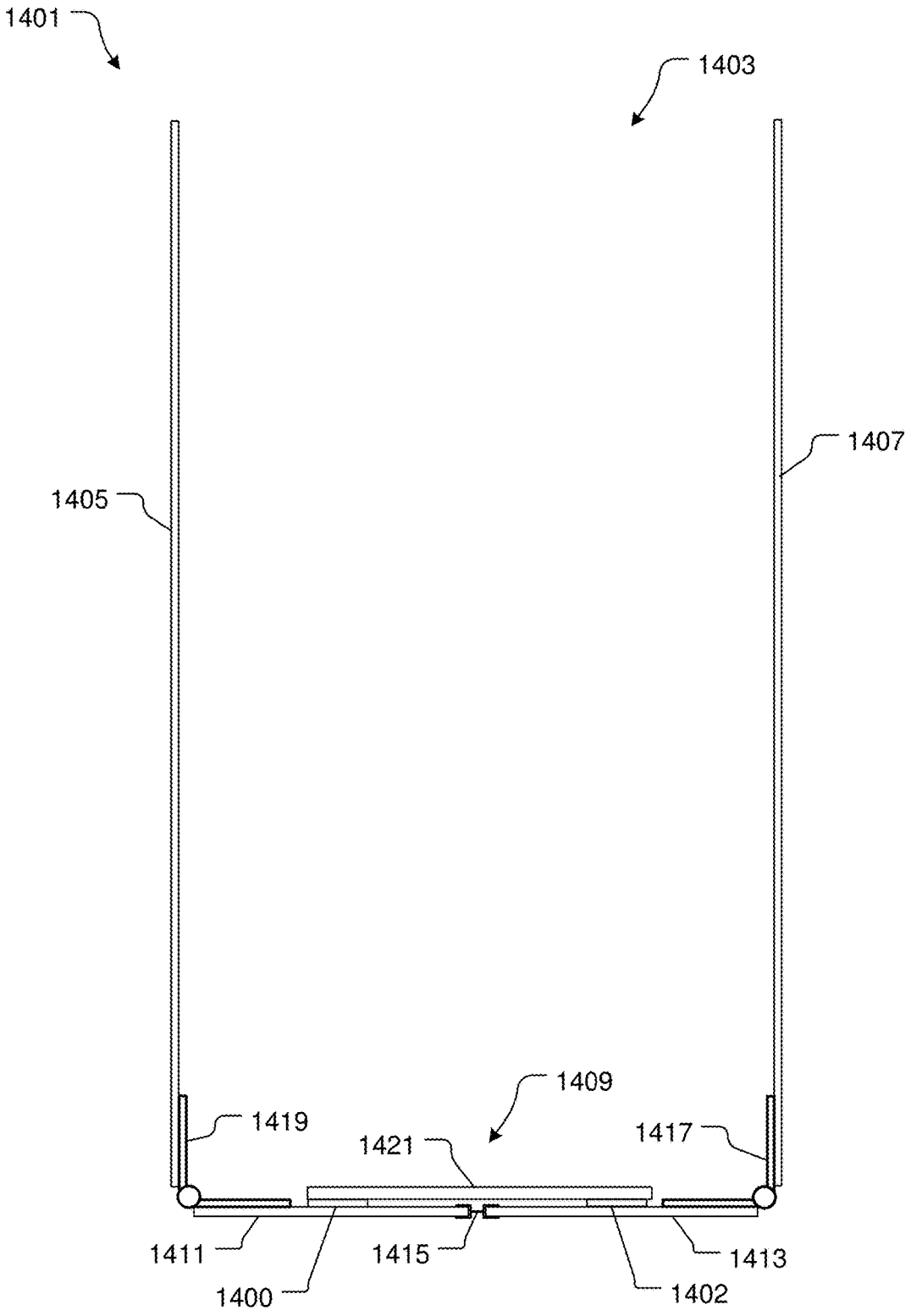
FIGS. 11-15 are various cross-sectionals side views of a bag with lighting system in accordance with an alternative embodiment of the present application.
Figure 12:
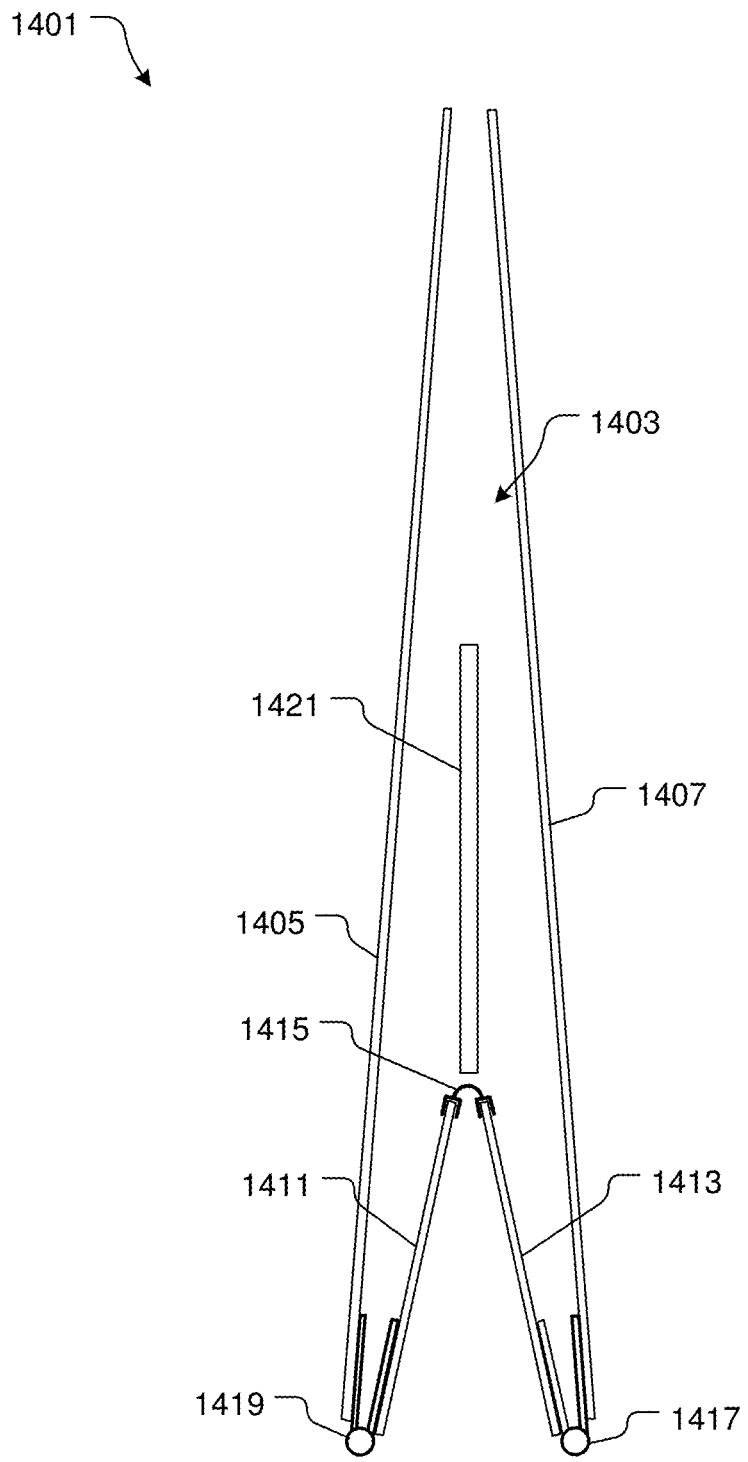

Bag 1401 includes a body that forms a cavity 1403 and has two sides 1405, 1407 and a bottom 1409. The bottom 1409 includes two sections 1411, 1413 that separated from each other and secured via a hinge 1415 Two additional hinges 1417, 1417 are configured to pivotally attach the bottom sections to the sides, as illustrated in the drawings. In FIG. 11, the lighting system 1421 rests on the bottom 1409 As shown in FIG. 12, the lighting system 1421 is removably attached to the bottom 1409 and the bottom and sides are folded via the hinges 1415, 1417, 1419. These features provide significant advantages; namely, the bag 1401 is folded in a position readily adaptable for transport and/or storage.

Figure 13:
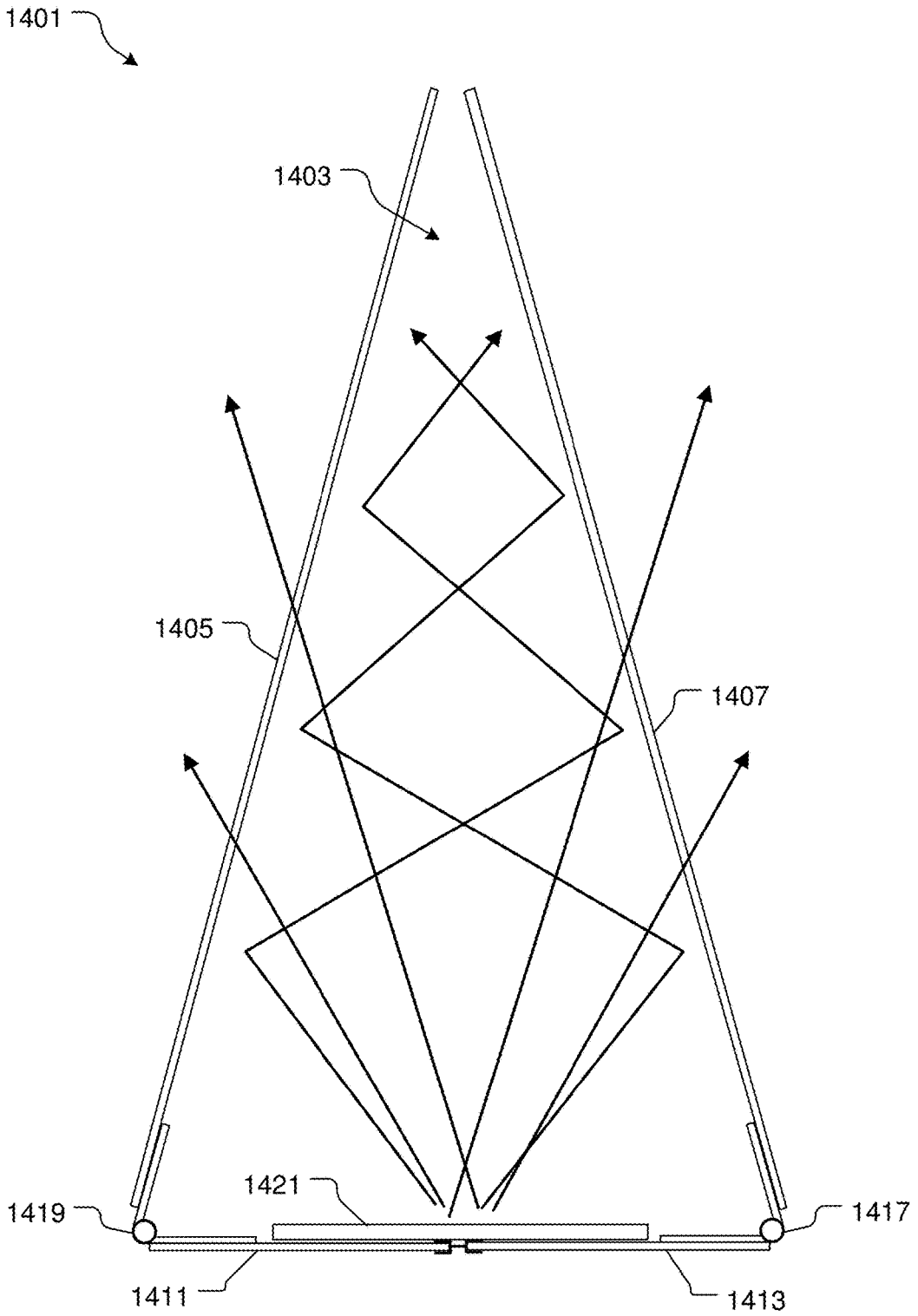
Figure 14:
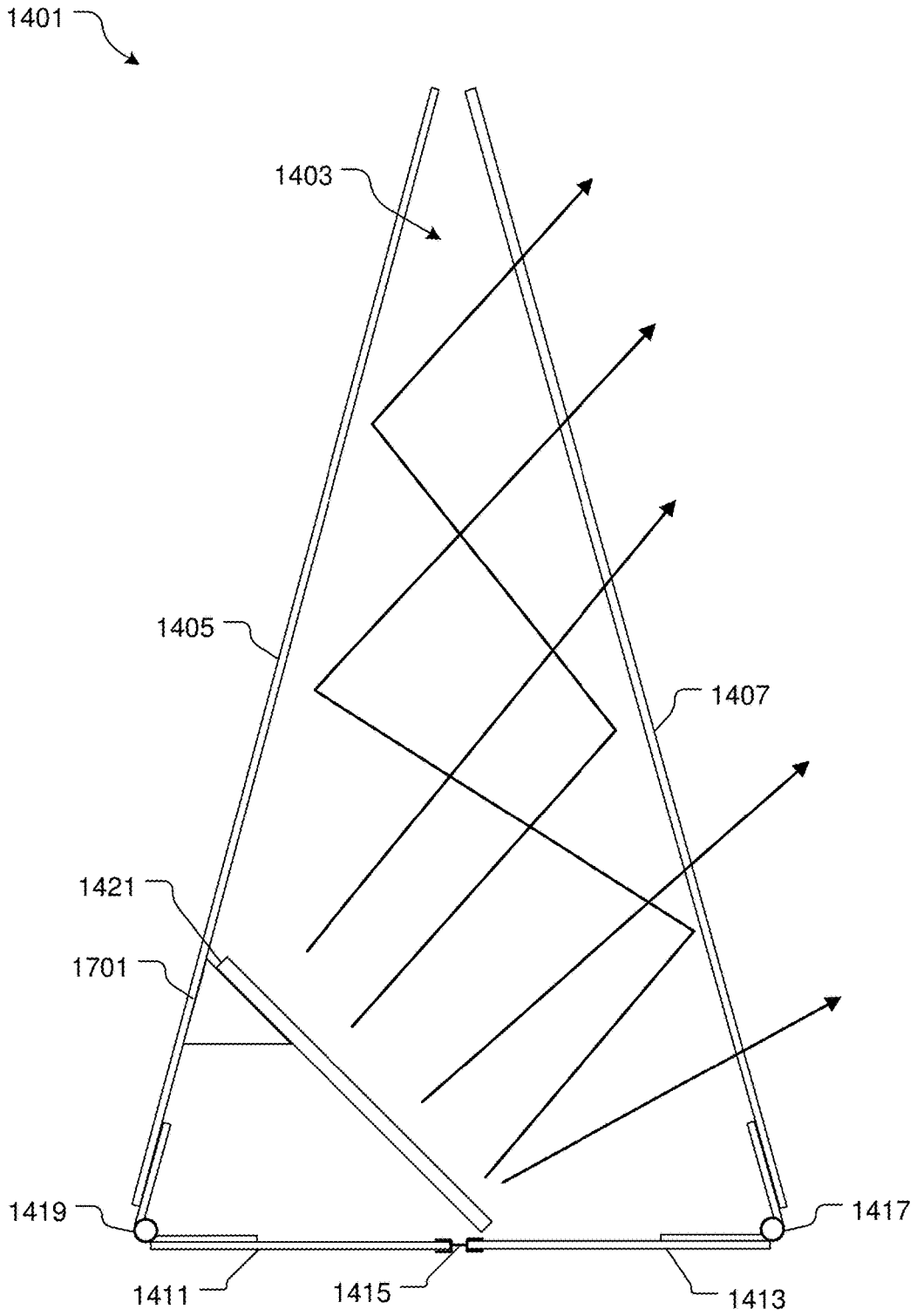

As shown in FIG. 13, the lighting system 1421 is configured to illuminate the enclosed area 1403 and sides 1405, 1407. Accordingly, it will be appreciated that the sides 1405, 1407 could be composed of a light transmitting substrates material that allows light to pass therethrough. This includes translucent, transparent, semi-opaque, and fluorescent substrates In FIG. 14, it is contemplated having a fastener 1701 adapted to engage with side 1405 and lighting system 1421. This feature allows the user to angle the lighting system 1421 relative to the bottom surface of the bag such that the light is concentrated in a direction through side 1407. In one embodiment, the fastener 1701 could be a magnet, clip, snap, hook-loop, and/or other quick-release fastener.

Figure 15:
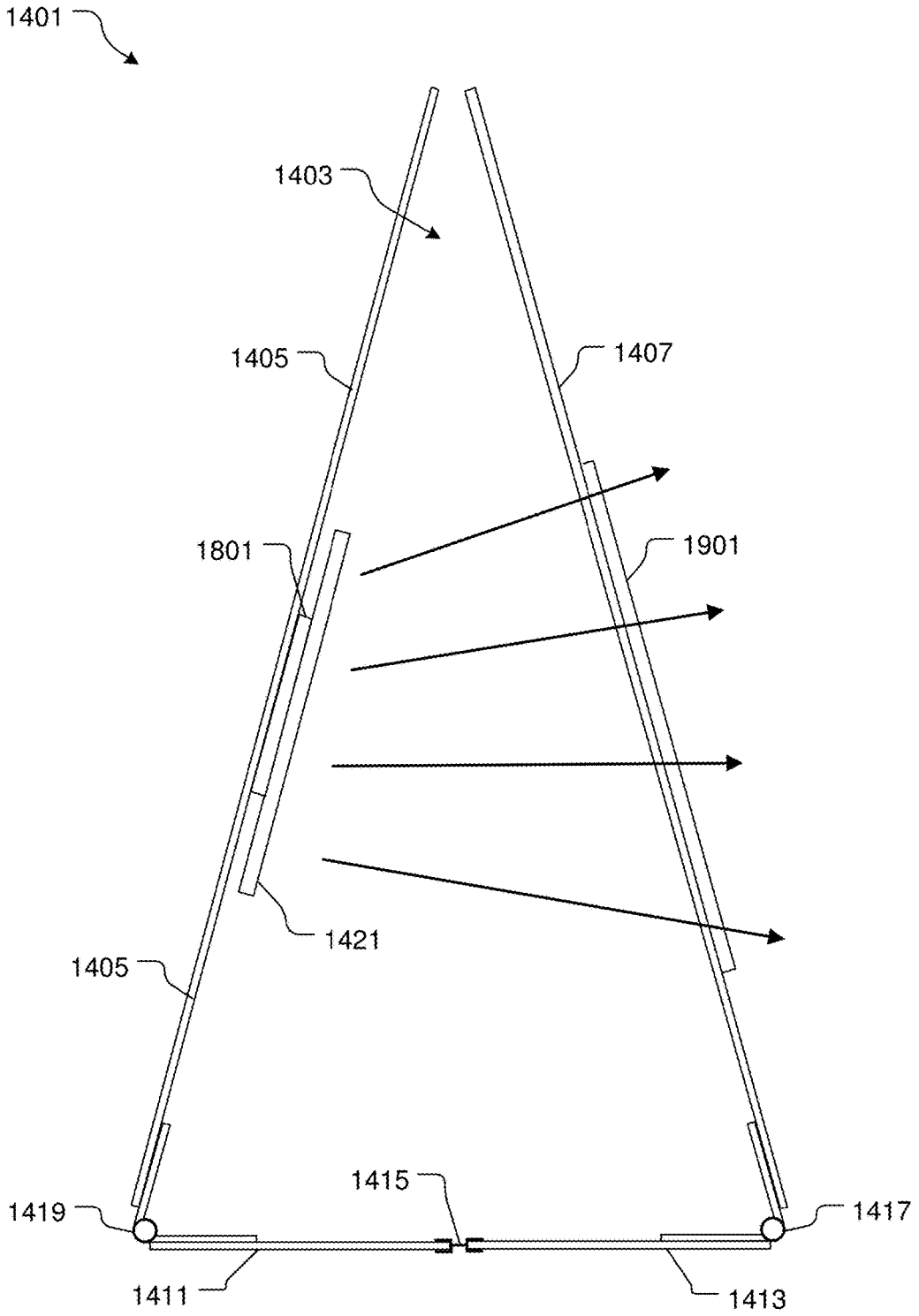

In FIG. 15, it is also contemplated having a fastener 1801 secured to an inner surface of side 1405 and configured to direct the light from system 1421 through side 1407. It will be appreciated that side 1407 could also include a graphic element 1901, as will be discussed in detail below with reference to FIGS. 16A and 16B. It will be appreciated that one or more of the bags discussed herein could include the features of graphic element 1901.

Figure 16A:
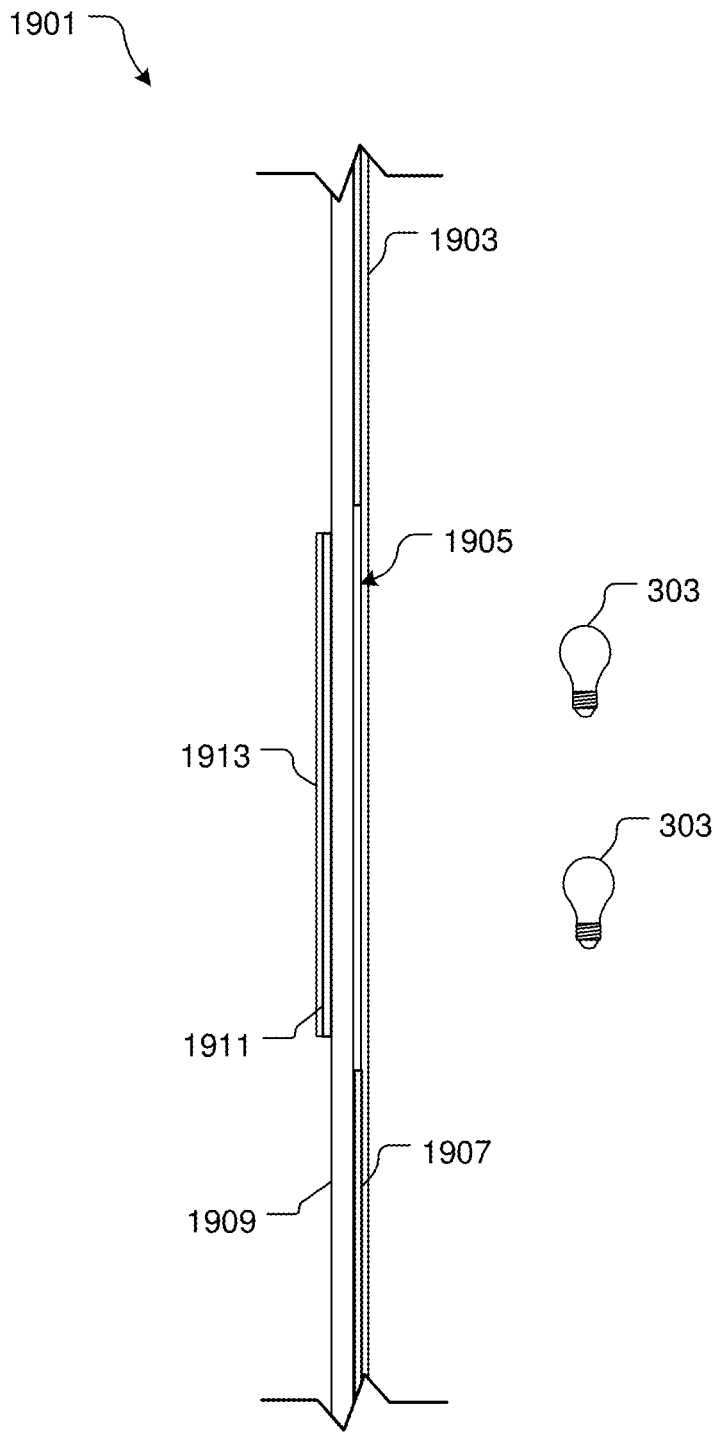
FIGS. 16A and 16B are respective assembled and exploded side views of light transmitting substrates and layering elements and a lighting system in accordance with an alternative embodiment of the present application.
Figure 16B:
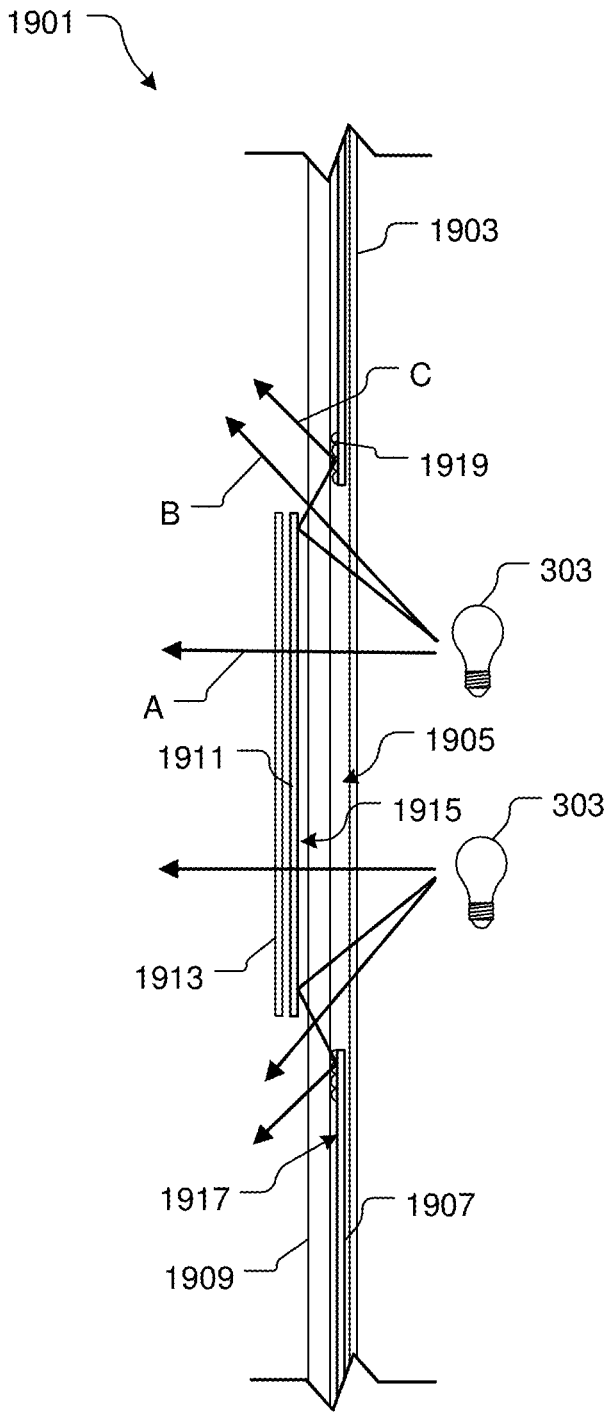

In FIGS. 16A and 16B, respective assembled and exploded side views of the graphic element 1901 are shown. Graphic element 1901 includes a diffuser layer 1903, a rear opaque layer 1907 that forms an opening 1905 for light to pass therethrough, a clear substrate 1909, a reflective layer 1911, and a front layer 1913. In the contemplated embodiment, the front layer 1913 is formed into a desired shape resembling an emblem, logo, and/or other configuration.

As shown in FIG. 16B, the light travels from light source 303 through opening 1905 and directly through the front layer 1913, as indicated by arrow A. Likewise, the light bounces off surfaces 1915 and 1917, as indicated by arrow C and travels through a gap between the reflective layer and the clear substrate, as indicated by arrow B. A surface treatment 1919 could cause additional refraction of the light as it reflects off surface 1917.

In the preferred embodiment, the light beam B creates a three dimensional appearance around the front layer 1913, while the light beam C creates a halo effect. It is also preferred to have a white colored reflective layer that reflects against a non-while rear opaque layer for additional aesthetic appearance.

Figure 17:
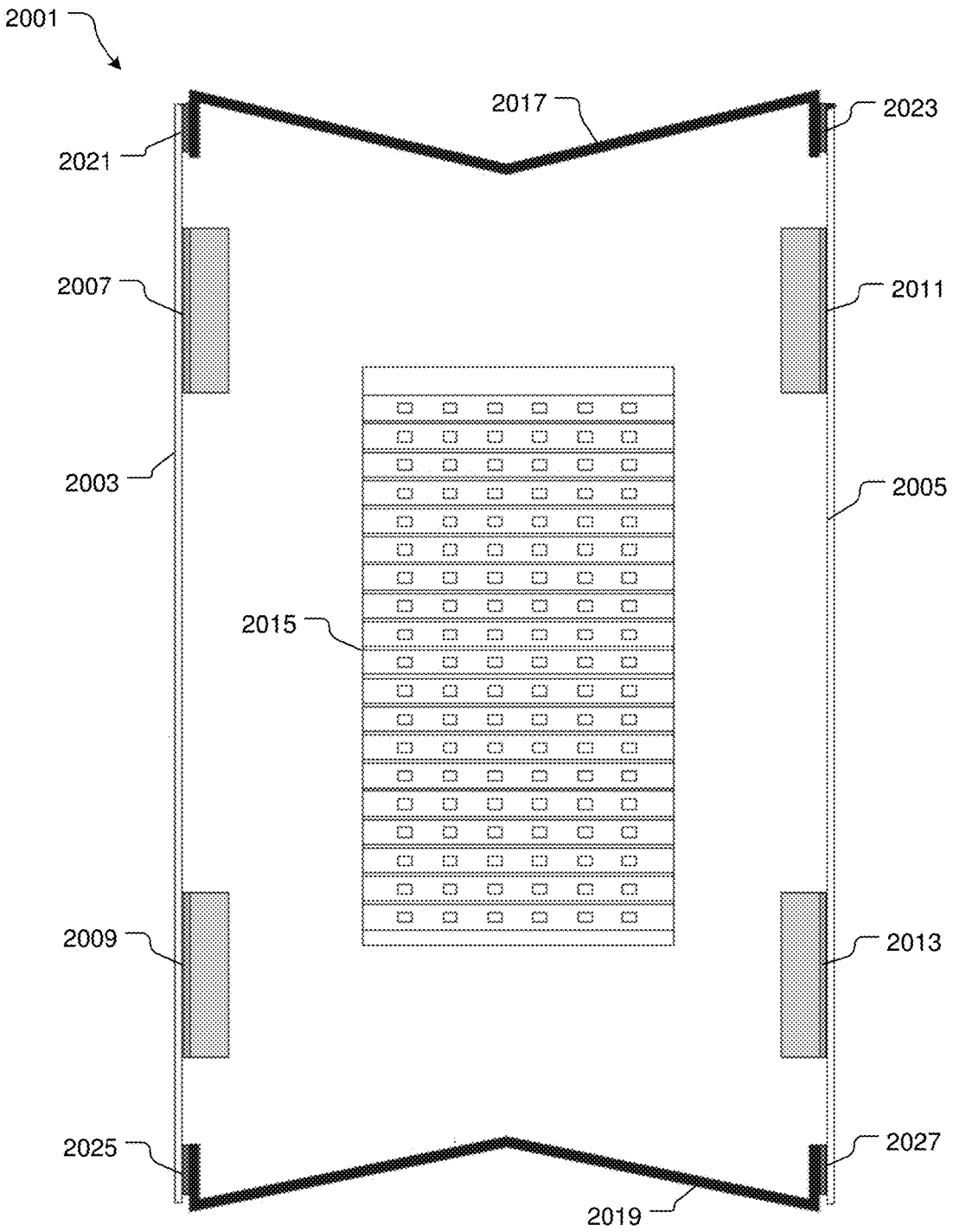
FIGS. 17, 18A, and 18B are top views of a bag with lighting system in accordance with an alternative embodiment of the present application.

Referring now to FIG. 17 in the drawings, a top view of a combination of a bag and lighting system 2001 in accordance with an alternative embodiment of the present application. It will be appreciated that bag and lighting system 2001 includes one or more of the features discussed above with the various embodiments of a bag and lighting system. In the contemplated embodiment, the bag and lighting system 2001 includes a front light transmitting substrate 2003, a back light transmitting substrate 2005 and two opposing sides 2017, 2019. The opposing sides 2017,2019 can be made of soft foldable material and rigid formed material which are removable The front substrate 2003 is joined to the bottom surface via hinges 2007, 2009 while back substrate 2005 is jointed to the bottom surface via hinges 2011, 2013. A light system 2015 secured to the bottom surface in the exemplary embodiment.

Figure 18B:
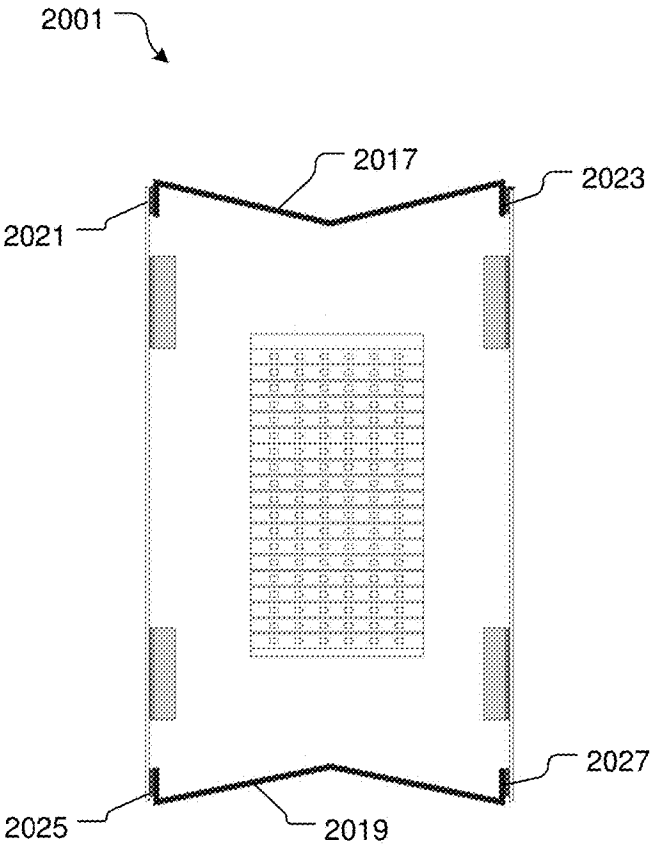
Figure 18A:
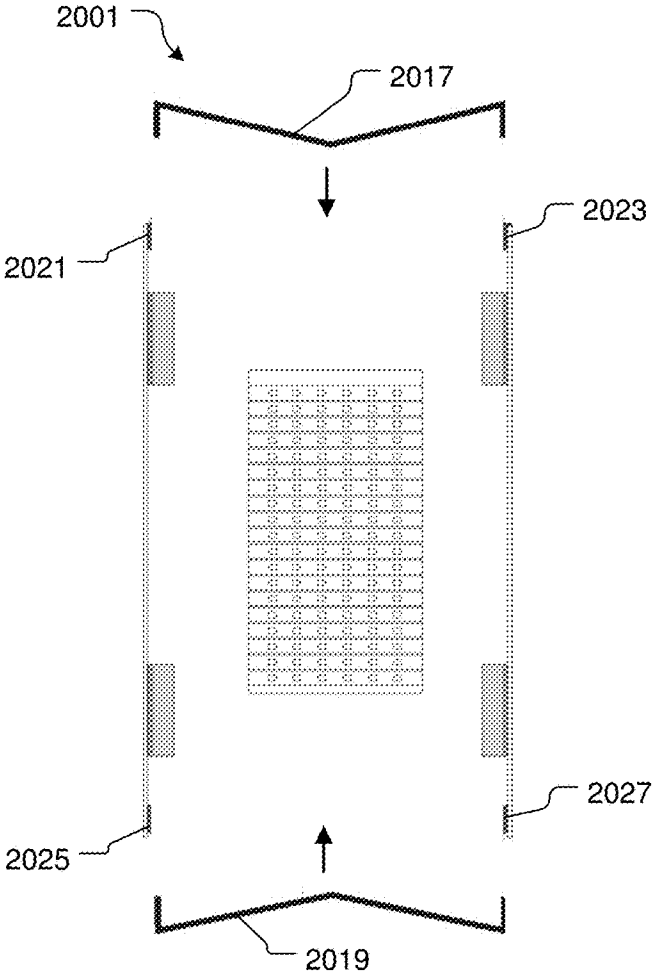

As shown in FIGS. 18A and 18B, one of the unique features of bag and lighting system 2001 is the removable side walls 2017, 2019 relative to the front and back substrates. This feature is achieved via locking devices 2021, 2023, 2025, and 2027 fixedly attached to inner surfaces of the front and back walls and removably attached to the side walls. In one contemplated embodiment, the locking devices are magnets; however, it is contemplated using hook-loop, snap, clips and the like in alternative embodiments.

Figure 19:
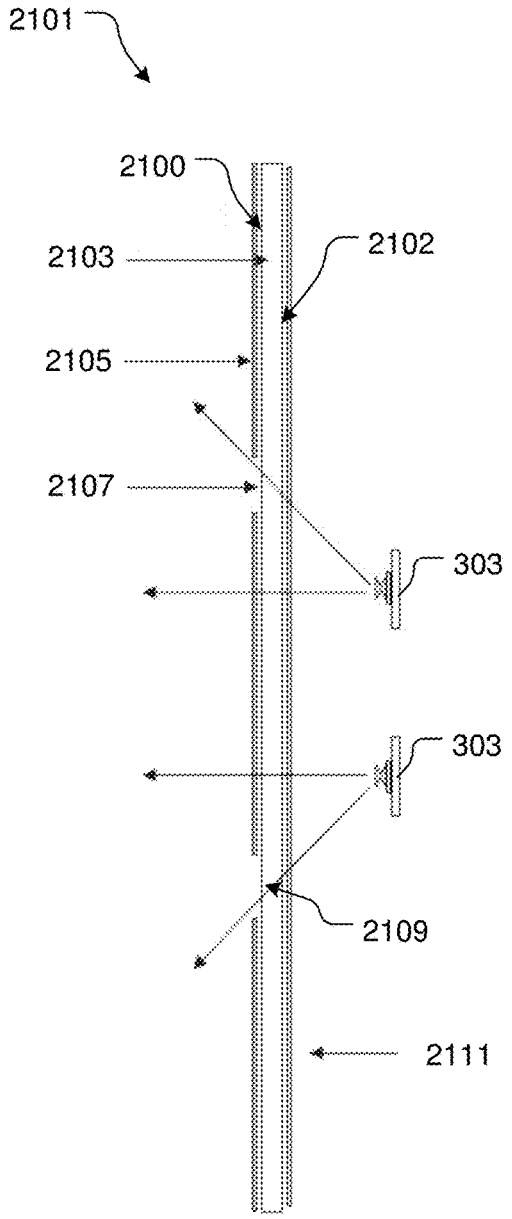
FIGS. 19 and 20 are side views of the light transmitting substrates and layering elements and a lighting system in accordance with alternative embodiments of the present application.
Figure 20:
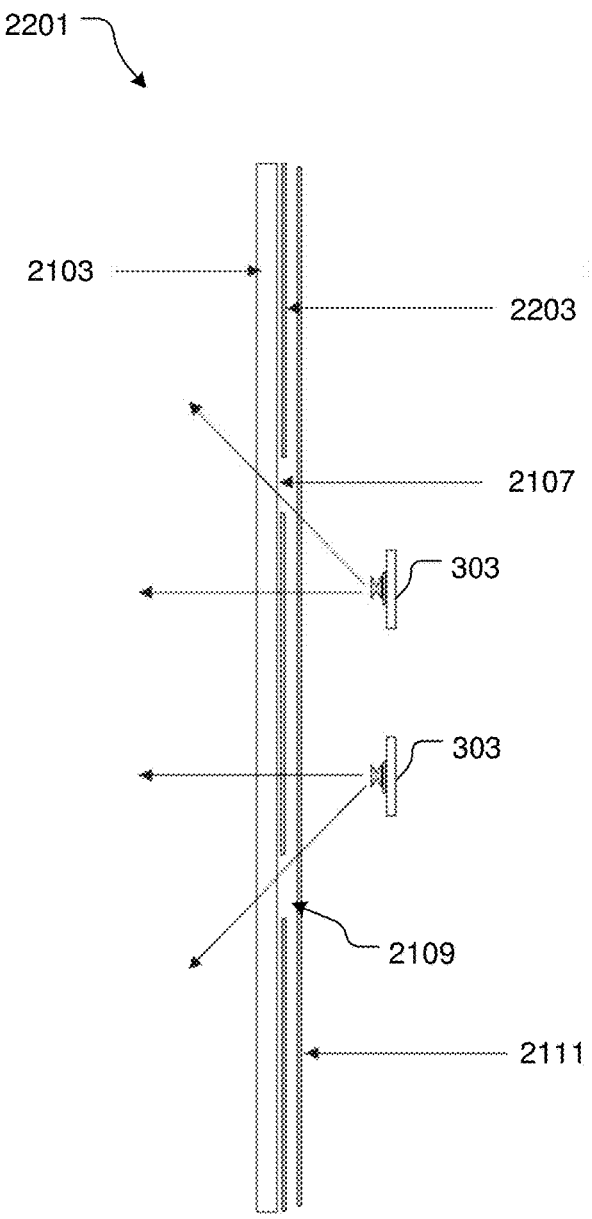

In FIGS. 19 and 20, two different embodiments of front and back substrates using layers forming graphic elements on front and back surfaces and lighting system are shown. It is contemplated using substrates 2101, 2201 in one or more of the different embodiments discussed herein. It should be appreciated that the features of systems 2101, 2201 could be utilized on any side of the different embodiments of the bags discussed herein.

System 2101 illustrates a light transmitting substrate 2103 with a front layer 2105 secured to a front surface 2100 of substrate 2103. In the contemplated embodiment, the front layer can be composed of any color or image for illumination. The front layer 2105 has a plurality of openings 2107, 2109 adapted to allow illumination from light sources 303 to pass therethrough. On the rear surface 2102 of substrate 2103 is a rear light transmitting diffuser layer, which is preferably composed of a reflective white and or translucent colored material.

System 2201 is substantially similar to system 2101; however, layer 2105 is not present on the front of substrate 2103. In the contemplated embodiment, rear layer 2203 is composed of a translucent or opaque material and includes any desired color and/or image.

Figure 21:
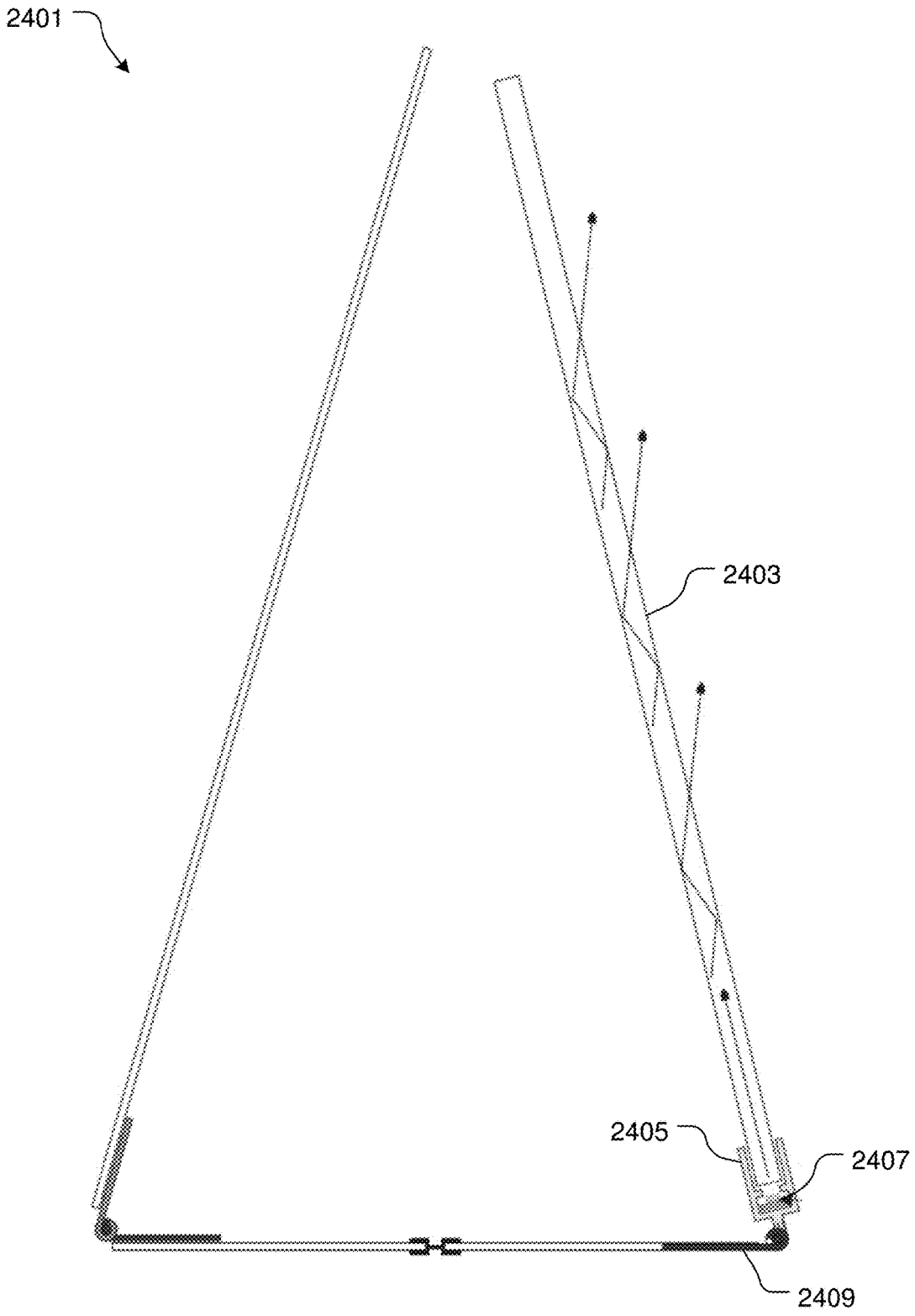
FIG. 21 is a side view of a bag with a lighting system in accordance with alternative embodiments of the present application.
Figure 22:
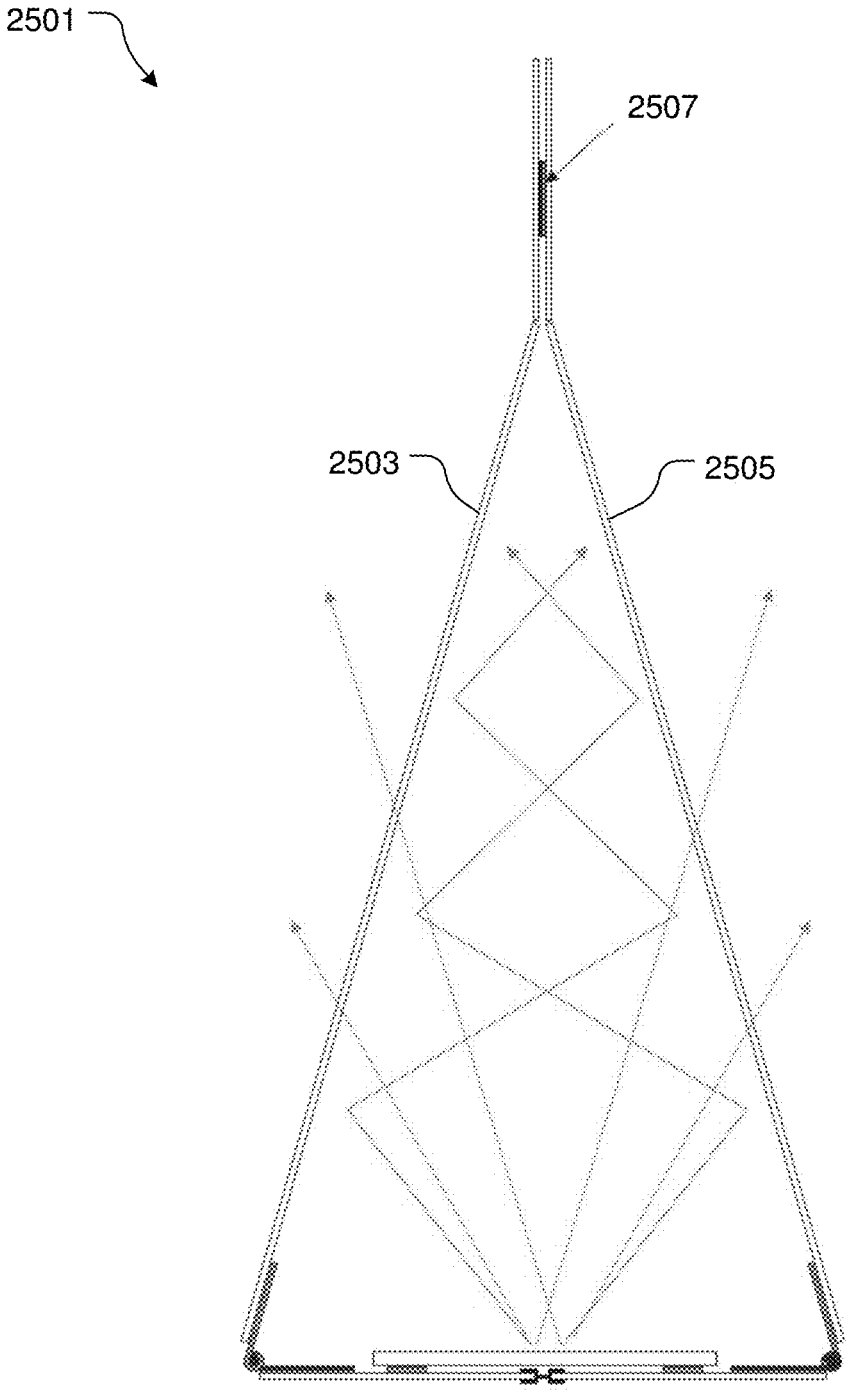
FIG. 22 is a side view of a bag with a lighting system in accordance with alternative embodiments of the present application.
Figure 23:
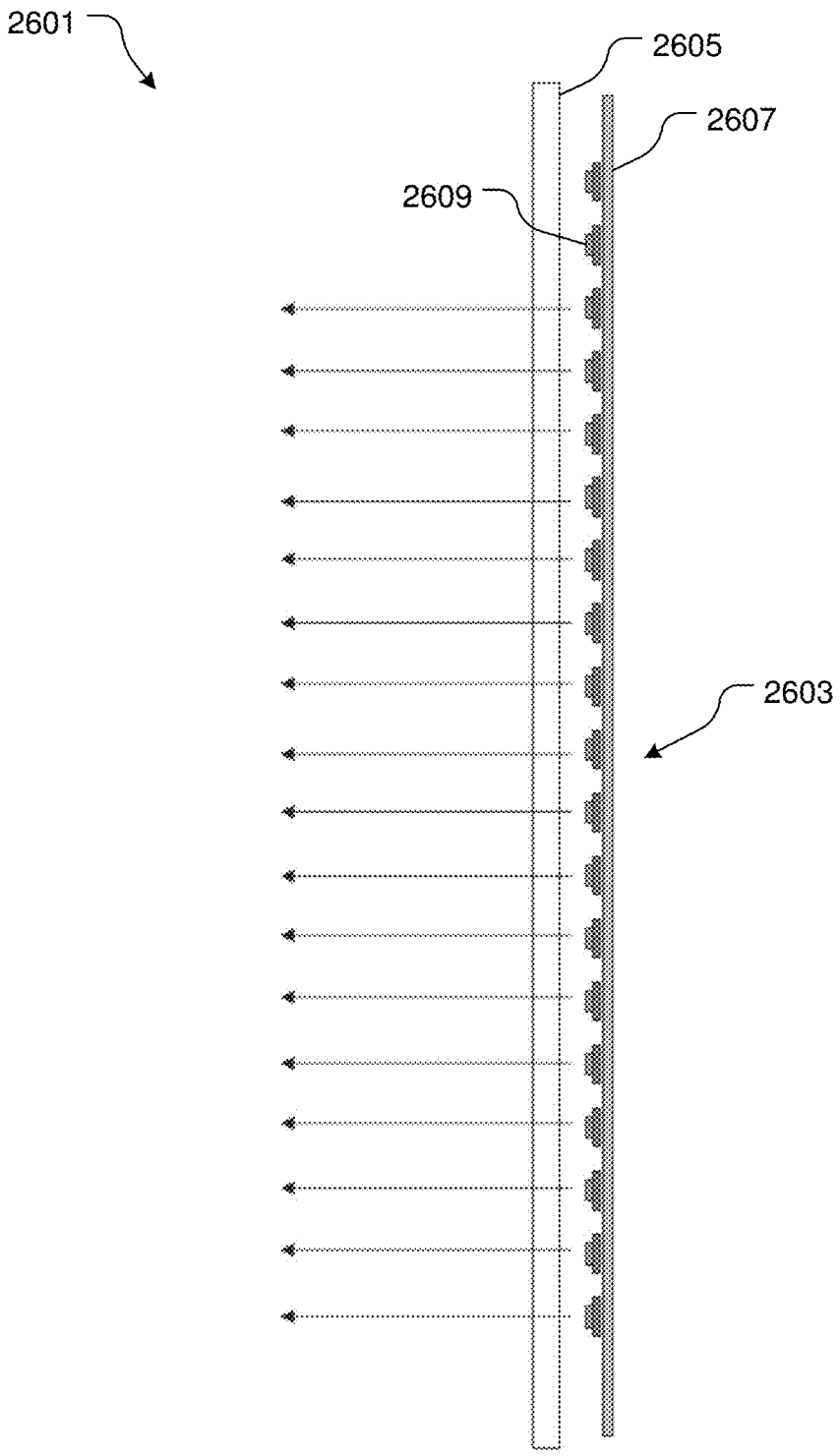
FIG. 23 is a side view of a lighting system and light transmitting substrates in accordance with alternative embodiments of the present application.

Referring now to FIGS. 21-23 in the drawings, various alternative embodiments of the present bag and lighting system are shown. It will be appreciated that the bag and lighting systems discussed above could utilize the features shown in systems 2401, 2501, and 2601.

In FIG. 21, it is contemplated utilizing one or more sides 2403 secured to a housing 2405 secured to hinge 2409 and having a lighting system 2407 disposed therein. The light from the lighting system 2407 travels through side 2403 as depicted with a plurality of arrows. In the contemplated embodiment, the substrate is composed of a transparent material and the light does not travel therethrough in a backlit fashion.

In FIG. 22, bag and lighting system 2501 includes two walls 2503, 2505 that fold onto each other and secure to each other via a locking device 2507. This feature provides means to enclose the open area created by the body of the bag, which in turn enable locking mechanism of the open cavity.

In FIG. 23, a side view of system 2601 is shown having an elongated lighting system 2603 positioned on one side of light transmitting substrate 2605 and extending substantially the length and width of the light transmitting substrate 2605. In the contemplated embodiment, the lighting system 2603 includes a member 2607 having a plurality of individual lights 2609 carried thereon. In the contemplated embodiment, a plurality of LED lights are utilized and the light transmitting substrate 2605 is configured to let light through and to be illuminated whether or not with additional layers added.

It should be understood that a light transmitting substrates include translucent, transparent and semi-opaque substrates which allow light to transmit through them from a light source placed on either side of the substrates In addition, a diffuser is utilized to distribute the light evenly.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A combination bag and lighting system, comprising:

the bag having:

a bottom surface;

two opposing sides;

a back side;

a front side;

a visual element secured to the front side;

a first hinge attached to the front side and the bottom surface; and a second hinge attached to the back side and the bottom surface;

wherein the first hinge and the second hinge allows pivot movement of the front side and the back side relative to the bottom surface;

wherein the two opposing sides, the back side and the front side form an inner cavity; and wherein the bag is foldable;

the lighting system carried within the inner cavity of the bag, the lighting system having:

a light source configured to create beams of light that pass through the front side and illuminates the visual element.

2. The combination of claim 1, further comprising: the bottom surface, having: a first section and a second section being separated from each other;

a third hinge secured to the first section and the second section, the third hinge being configured to allow pivot movement of the first section relative to the second section.

3. The combination of claim 2, wherein the light source is removably attached within the inner cavity of the bag.

4. The combination of claim 1, further comprising:

a fastener configured to removably secure the light source within the inner cavity of the bag.

5. The combination of claim 4, wherein the fastener secures the light sources at an angle relative to the front surface.

6. The combination of claim 5, wherein the fastener is a magnet.

7. The combination of claim 1, the light source further comprising:

a power device configured to provide electrical power to the light source.

8. The combination of claim 7, wherein the power device is a battery.

9. The combination of claim 1, wherein the light source is a plurality of LED lights.

10. A method to illuminate a visual element secured to a bag, the method comprising:

providing the combination bag and lighting system of claim 1;

illuminating an area around the visual element in a backlit fashion with the light source by channeling beams of light to pass through the opening of the rear oblique layer, through a clear substrate, and to reflect off a reflective layer and the rear oblique layer.

11. The method of claim 10, further comprising:

folding the front side and the back side relative to the bottom surface with the first hinge and the second hinge.

12. The method of claim 11, further comprising:

securing the light source to the front wall via a fastener.

13. A combination bag and lighting system, comprising:

the bag having:

a bottom surface;

two opposing sides;

a back side;

a front side, having:

a transparent substrate with a front surface and a back surface; and a rear diffuser layer secured to the back surface; and a visual element secured to the front side;

wherein the two opposing sides, the back side and the front side form an inner cavity;

the lighting system carried within the inner cavity of the bag, the lighting system having:

a light source configured to create beams of light that pass through the transparent substrate, is reflected on the rear diffuser layer, and illuminates the visual element.

14. The combination of claim 13, wherein the bag is foldable.

15. The combination of claim 14, further comprising:

a first hinge attached to the front side and the bottom surface; and a second hinge attached to the back side and the bottom surface;

wherein the first hinge and the second hinge allows pivot movement of the front side and the back side relative to the bottom surface.

16. The combination of claim 13, further comprising:

a front layer secured to the front surface of the transparent substrate, the front layer forming a plurality of openings for light to pass therethrough.

17. The combination of claim 13, further comprising:

a rear opaque layer secured to the back surface of the transparent substrate, the rear opaque layer forming a plurality of openings for light to pass therethrough.

18. The combination of claim 13, wherein the light transmitting substrate is edge lit.

* * * * *